US005536569A

United States Patent [19]

Lasch et al.

[11] Patent Number: 5,536,569

[45] Date of Patent: Jul. 16, 1996

[54] THERMOPLASTIC MARKING SHEET

[75] Inventors: James E. Lasch, Oakdale; Terry R. Bailey; Gregory F. Jacobs, both of Woodbury; Roger R. Kult, Maplewood, all of Minn.

[73] Assignee: Minnesota Mining and Manufacturing Company, St. Paul, Minn.

[21] Appl. No.: 375,562

[22] Filed: Jan. 13, 1995

Related U.S. Application Data

[63] Continuation of Ser. No. 836,190, Feb. 13, 1992, abandoned, which is a continuation of Ser. No. 632,976, Dec. 24, 1990, abandoned.

[51] Int. Cl.[6] ..... B32B 5/16; B32B 5/30

[52] U.S. Cl. ..... 428/328; 428/213; 428/220; 428/325; 428/339; 428/354; 428/908.8; 359/540; 404/14; 404/19; 404/20

[58] Field of Search ..... 359/540; 404/12, 404/14, 17, 19, 20, 21; 428/343, 354, 323, 213, 220, 325, 328, 339, 908.8

[56] References Cited

U.S. PATENT DOCUMENTS

| | | | |
|---|---|---|---|
| 3,337,483 | 8/1967 | Searight et al. | 260/17 |
| 3,451,537 | 6/1969 | Freeman et al. | 206/59 |
| 3,936,567 | 2/1976 | Vesely | 350/105 X |
| 4,117,192 | 9/1978 | Jorgensen | 428/337 |
| 4,248,932 | 2/1981 | Tung et al. | 428/323 |
| 4,282,281 | 8/1981 | Ethen | 428/325 X |
| 4,299,874 | 11/1981 | Jones et al. | 428/354 X |
| 4,410,582 | 10/1983 | Tsunashima et al. | 428/212 |
| 4,490,432 | 12/1984 | Jordan | 428/220 |
| 4,511,210 | 4/1985 | Tung et al. | 350/105 |
| 4,648,689 | 3/1987 | May | 404/14 X |
| 4,648,932 | 3/1987 | Bailey | 156/276 |
| 4,876,141 | 10/1989 | Kobayashi et al. | 428/217 |
| 4,921,754 | 5/1990 | Ishihara | 428/216 X |
| 4,937,127 | 6/1990 | Haenggi et al. | 428/212 X |
| 4,983,436 | 1/1991 | Bailey et al. | 350/105 X |
| 4,990,024 | 2/1991 | Eigenmann | 404/12 |
| 5,082,715 | 1/1992 | Lasch et al. | 428/143 |

FOREIGN PATENT DOCUMENTS

| | | | |
|---|---|---|---|
| 0162229 | 3/1985 | European Pat. Off. . | |
| 0208341 | 3/1986 | European Pat. Off. . | |
| 304405 | 2/1989 | European Pat. Off. . | |
| 0377289 | 12/1989 | European Pat. Off. . | |
| 2643854 | 9/1990 | France . | |
| 2-54922 | 11/1990 | Japan | G02B 5/128 |
| 5-33661 | 5/1993 | Japan . | |
| WO91/06708 | 5/1991 | WIPO . | |

*Primary Examiner*—James D. Withers
*Assistant Examiner*—Blaine R. Copenheaver
*Attorney, Agent, or Firm*—Douglas B. Little; Gary L. Griswold; Walter N. Kirn

[57] ABSTRACT

Thermoplastic based pavement marking sheets are disclosed. The marking sheets employ a conformant composite material including: polyolefin and a nonreinforcing mineral particulate; and/or a thermoplastic upper surface. Preferably, the sheet's thermoplastic upper surface is embedded with reflective elements and/or skid-resistant particles. A solventless process of embedding particles in thermoplastic pavement marking sheets is disclosed. Processes for preparing marking sheets are also disclosed. Conformant pavement marking sheets which may be applied in cooler conditions are also disclosed.

8 Claims, 1 Drawing Sheet

THERMOPLASTIC MARKING SHEET

This is a continuation of application Ser. No. 07/836,190 (now abandoned) filed Feb. 13, 1992, which is a continuation of Ser. No. 07/632,976 filed Dec. 24, 1990.

TECHNICAL FIELD

The present invention relates to polymeric sheeting, specifically sheeting used to mark surfaces such as highways. In particular, it relates to pavement marking tapes employing a thermoplastic polymer.

BACKGROUND

Roadway marking tapes have advantages over painted markings on roadways. Those advantages include more effective reflective properties, potential removability, and a potentially longer service life. The use of various types of polymeric sheeting products in roadway marking tapes has been known for years.

Some of the deficiencies associated with known pavement marking tapes include (1) conformance difficulties; (2) limited temperature ranges for application to a highway surface; (3) environmental and health concerns associated with the production of the marking tapes (particularly concerns about solvent vapors generated during production); (4) high production cost (specifically, raw material costs and waste due to difficulties in controlling complex production processes); and, for temporary markings, (5) inadequate mechanical properties (tensile strength) for removability.

The practical significance of inadequate conformance is a tendency toward inadequate initial or permanent adhesion of the marking tape to the roadway surface. The nonconformant or elastic nature of some tapes may result in a tendency toward recovery of initial shape after the tape has been deformed by tamping during application. If the tendency to recover exceeds the adhesive force attaching the tape to the pavement, detachment occurs. Once a marking tape becomes prematurely detached from the roadway surface, advantages such as more effective reflective properties and potentially longer service life can not be realized.

Adhesion problems are often exacerbated by rain on the highway surface. Water in small pockets between the tape and the roadway surface may act to hydraulically lift the tape from the roadway surface especially when under the action of traffic and/or freezing and thawing environmental conditions.

Previous approaches to improved conformance of marking tapes employed either metallic foil or nonvulcanized-rubber base layers. Softer, more easily conformable and less elastic tapes gain an improved adhesion to the roadway surface but suffer from reduced durability and are subject to relatively rapid wear by traffic. Additionally, such materials are characterized by low tensile and tear strength and, thus, are generally unsuitable as removable, temporary pavement marking tapes. Often additional components, such as nonwoven fabric, are added to enable removability. Such materials increase the cost of the marking tape.

Mineral particulates have been used previously in polymers as fillers to reduce costs; as reinforcements to increase mechanical properties (tensile strength, tensile modulus, and hardness) or improve thermal properties; and as extenders to partially substitute for costly pigments such as titanium dioxide. Generally, finer particulates have been favored as extenders and reinforcements. The applicants are unaware of the prior use of particles in thermoplastic materials to form composites with improved conformance properties for roadway marking tape.

For years, the typical method of attachment of reflective beads and, optionally, skid-resisting particles to road marking tapes has been embedding of the beads and/or skid resisting particles into uncured polymeric systems or dissolved polymers. Each of these attachment processes suffers from a disadvantage. For example, if a solvent system is employed, the production of solvent vapors must be handled. Solvent vapors are increasingly of environmental and health concern in production facilities.

Another concern with removable temporary pavement marking tapes is a disposal concern. Waste materials which include chlorinated hydrocarbons are increasingly looked upon with disfavor for landfill disposal or incinerator disposal.

In view of the above-described deficiencies associated with known marking tapes or sheets, a desirable marking sheet would embody the following properties:

Excellent conformance to the substrate surface

Extended temperature range for application

Removability

Reduced disposal concerns

Solvent-less or near solvent-less production

Lack of dependence on critical reaction kinetics for bead bonding

Reduced raw material costs

Acceptable durability

The present invention, as disclosed below, satisfies these requirements and includes new pavement marking sheets, processes for manufacturing the marking sheets, and a new composite material of the sheet.

SUMMARY OF THE INVENTION

The present invention includes a conformable marking sheet, having a top surface useful as a marking indicium. The sheet includes a conformance layer, from about 75 to about 1250 micrometers in thickness, of a composite material which includes a ductile thermoplastic polymer and a nonreinforcing mineral particulate. By ductile is meant that the material is deformable to 115% of its original length (i.e. 15% strain) at a strain rate of 0.05 $sec^{-1}$ and at least 10% of that strain is maintained after the deforming force is removed. For purposes of this description, deformable to some percentage of original length means that a previously undeformed material can withstand, without breaking, a stretching or elongation to its original length multiplied by the particular percentage (e.g. a 115% deformation (i.e 15% strain) of a 10 cm long sample would stretch or elongate the sample to a length of 11.5 cm without breaking.) The thermoplastic polymer comprises from about 50 to about 85 volume percent of the composite material. The mineral particulate has a mean particle size of at least 1 micrometer and comprises from about 15 to about 50 volume percent of the composite material. The conformance layer exhibits, when tested at 25° C. using standard tensile strength apparatus, not more than 20 lbs. of force per inch width (35 Newtons (NT) per cm of width) to deform a sample to 115% of original sample length when tested at a strain rate of 0.05 $sec^{-1}$.

Preferably, the thermoplastic is a polyolefin. The polyolefin may be chosen from the group consisting of polyethylene, ethylene copolymers, polypropylene, ethylene-propylene-diene terpolymers, polybutylene polyvinylidene fluoride, polytetrafluoroethylene, polyvinyl polyamides, polyurethanes, and mixtures thereof. Linear low density polyethylene (LLDPE) is preferred as a polyolefin. Ultra low density polyethylene (ULDPE) is a most particularly preferred polyolefin component. The nonreinforcing mineral particulate may be calcium carbonate.

The conformable marking sheet is generally useful as a roadway marker. The conformable marking sheet is especially useful as a marking sheet which may be effectively applied to roadways during cooler conditions (e.g. 2° C.). This property serves to extend the application season into fall and spring conditions. This cool weather conformance is primarily contributed by the above mentioned composite material of the conformance layer. Remarkably, the layer of composite material contributes not only desirable conformance properties to the marking sheet but also may contribute acceptable wear resistance and adequate tensile strength and tear resistance to enable efficient removal of a roadway marker including such a layer. Use of the composite material in a conformance layer of this invention enables elimination of nonwoven fabric scrim components or equivalent components in temporary, removable roadway marker tapes. It is possible to use a thinner adhesive coating on the bottom of the sheet without a fabric scrim. Nonwoven scrim may be added, however, to contribute additional tensile strength or tear resistance. Scrim, if employed, can also provide reinforcement or padding between a top layer and the roadway.

The present invention also includes a process for making a conformable marking sheet. The process includes the steps of providing a sheet of the above mentioned composite material. The sheet of composite material is characterized by exhibiting when tested at 25° C. using a standard tensile strength apparatus not more than 20 lbs. force per inch width (35 NT per cm of width) to deform a sample to 115% of original sample length when tested at a strain rate of 0.05 $sec^{-1}$. To this sheet is bonded a top layer which is flexible and useful as a marking indicium.

The process of making the conformable marking sheet may also include the steps of providing a casting roller with a cooled surface and an accompanying nip roller. A carrier web is fed through the nip. The conformant material is melt extruded onto .the carrier web. Next, a flexible thermoplastic top layer is melt extruded onto the composite material. The laminate is softened by heating and particles applied to the softened surface of the thermoplastic top layer. A pressure sensitive adhesive layer may be laminated to the construction.

The present invention also includes a process for making a conformable marking sheet by co-extruding a first conformant layer of composite material and a second or top layer including a thermoplastic polymer. The second layer is useful as a marking indicium. The thermoplastic of the second or top layer is chosen from: ethylene acrylic acid (EAA) copolymers, ethylene methacrylic acid (EMAA) copolymers, polyethylene (PE), ethylene copolymers, polypropylene (PP), ethylene-propylene-diene terpolymers (EPDM), polybutylene, ionically cross-linked ethylene methacrylic acid copolymer, ethylene n-butyl acrylate (EnBA), ethylene vinyl acetate (EVA), ethylene ethyl acrylate (EEA) copolymer, and ethylene methyl acrylate (EMA) copolymer. The conformant composite material of the first layer is from 50 to 85% by volume ductile thermoplastic and 15 to 50% by volume nonreinforcing mineral particulate of at least 1 micrometer mean particle size.

The present invention also includes a process for embedding particles in a surface of a pavement marking sheet. The process is particularly useful for embedding reflective elements and/or skid-resisting particles. The process includes the steps of providing a thermoplastic sheet having an exposed surface; heating the sheet to a temperature sufficient to soften the thermoplastic of the sheet; applying particles which are desired to be embedded to an upward directed a surface of the softened thermoplastic sheet; maintaining the sheet in a softened condition for a period of time sufficient to achieve a desired level of embedding of the particles into the surface of the softened sheet; and cooling the sheet to a temperature below the softening temperature. The embedding method may also employ a nip to urge the particles into the softened sheet. The present invention also includes a marking sheet including a layer having an exposed surface useful as a marking indicium and particles semi-embedded in the exposed surface. The marking sheet layer may also include a blend including such polymers.

The present invention also includes a marking sheet including a layer useful as a marking indicium comprising a polymer selected from materials which may be suitably employed as top layers, as listed above, and a pressure sensitive adhesive laminated to the polymeric layer. The marking sheet layer may also include a blend including such polymers.

The present invention also includes embodiments which are suitable as low temperature removable roadway marking tape. In general, removability of marking tape requires that the tensile strength of the tape be greater than the peel force of the tape from the roadway. In use, the peel force of the tape may increase as traffic forces the tape repeatedly into more intimate contact with the roadway surface. For removal of a tape in cool conditions (e.g. 2° C.), a tensile strength in excess of 10 lbs. per inch width (18 NT per cm width) may be necessary. An embodiment of a conformable marking sheet of this invention includes a top surface which is useful as a marking indicium and a conformance layer which requires at 2° C. not more than 18 NT force per cm width to deform to 115% of original sample length when tested at a strain rate of 0.05 $sec^{-1}$ (using a standard tensile strength apparatus) and not more than 5 NT unloading force per cm width at 110% deformation following a 115% deformation.

DETAILED DESCRIPTION OF THE PREFERRED EMBODIMENTS

Figure 1:
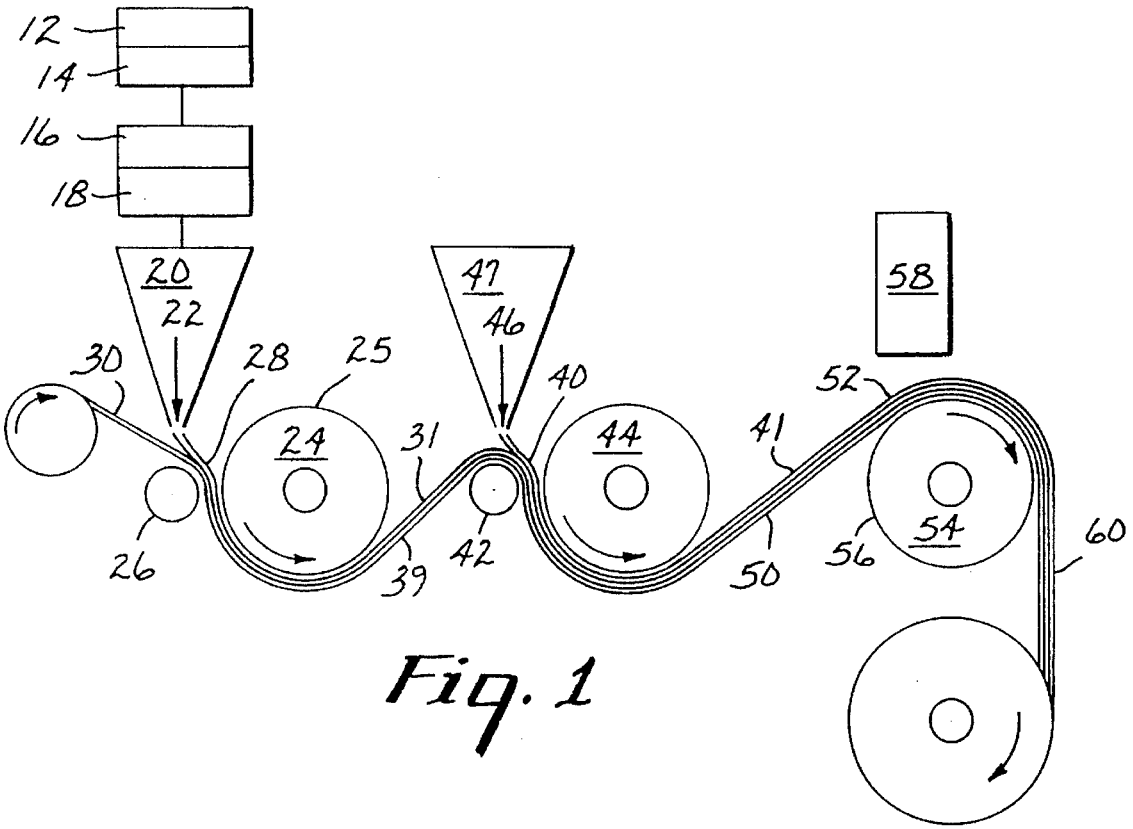
FIG. 1 is a schematic of an embodiment of a process of the present invention.

The present invention, in a first embodiment, is a conformant marking sheet which is particularly useful for marking a roadway. Typical roadway surfaces are rough rather than smooth. Good adhesion of a marking sheet to a roadway surface depends largely on the marking sheet adapting to and accommodating the surface irregularities of the roadway. A layer of a composite material provides the basis for the conformance property in this invention.

In describing the invention, this composite material and its preparation are described first. The formation of a conformant layer from the composite material is described second, followed by lamination to form conformant marking sheets. Next, a thermoplastic top coat is described. A particle embedding process is described next, followed by tests for quantification of conformance and other useful properties of marking sheets. Finally, examples of some of the embodiments of the invention are described.

Composite Material

The composite material used in the conformant layer has two primary components: a ductile thermoplastic polymer and a nonreinforcing mineral particulate. Preferably, the thermoplastic polymer is a polyolefin.

Polyolefins suitable for use in the composite material include polyethylene, polypropylene, polybutylene, and copolymers of those materials. Preferably, the polyolefin is a polyethylene or a linear polyethylene copolymer prepared in part from propylene, butene, hexene, or octene monomers. More preferably, the polyethylene is an ultra low density polyethylene (ULDPE). Ultra low density polyethylene means linear ethylene copolymers with densities of not greater than 0.915 g/cm$^3$. The melt index of suitable polymers is not more than 300 g/10 minutes by ASTM method 1238–79. The melt index of the most preferred polymer components of the composite material should be less than about 20 g/10 minutes as measured by ASTM method D1238.

ULDPE formed as an ethylene-octene copolymer with from about 3–8 mole percent octene is preferred and about 5 mole percent octene, is most particularly preferred. For example, Attane 4001 brand ULDPE; Attane 4002 brand ULDPE; and Attane 4004 brand ULDPE, available from the Dow Chemical Company of Midland, Michigan are suitable components. Densities of such polyethylenes are in the range of about 0.880–0.915 g/cm$^3$ and the most preferred ULDPE has a density of about 0.912 g/cm$^3$ as measured by ASTM method D792. Dow 4001 and 4004 are characterized by densities of 0.912 g/cm$^3$ melt indices of 1.0 g/10 minutes and 3.3 g/10 minutes respectively, and are thought to contain about 4.5 mole percent octene.

The density of a polymer is indicative of the crystallinity in the bulk polymer. For ethylene copolymers with comonomers other than α-olefins (e.g., ethylene vinyl acetate or ethylene acrylic acid) a polymer of a given crystallinity would have a different density than the polyethylene of the same crystallinity. Therefore, when selecting or predicting suitability of such polymers, it is more appropriate to consider their crystallinities rather than their densities.

The crystallinity of polymers may be determined by several well-known methods. One method, the bulk density method, may be used to calculate the crystallinity of polymers according to the formula:

$$\frac{1}{D} = \frac{x_C}{D_C} + \frac{x_A}{D_A}$$

where $D_C$, $D_A$ and D are the crystalline, amorphous and bulk densities, respectively, and $x_C$ and $x_A$ are the weight fractions of crystalline and amorphous materials. Accepted values for $D_A$ and $D_C$ are 0.855 g/cm$^3$ and 1.000 g/cm$^3$ respectively, for polyethylene and are applicable to ethylene copolymers if only α-olefin comonomers are used.

Polymer crystallinity may also be determined using Differential Scanning Calorimetry (DSC) by measurement of the enthalpy of the crystalline melting. The crystallinity is given by $$X_C = \Delta H_{mx}/\Delta H_{mt}$$

where $\Delta H_{mt}$ is the theoretical enthalpy of fusion of 100% crystalline polymer ($\Delta H_{mt}$ = 66 cal/gm for polyethylene) and $\Delta H_{mx}$ is the experimentally determined enthalpy of fusion of the polymer sample. The density range of 0.880 to 0.915 for polyethylene copolymers with e-olefin comonomers corresponds to theoretical crystallinities of 19.6 to 45.2%.

One suitable ULDPE, Attane 4001, having a density of 0.912, has a theoretical crystallinity (as calculated from its bulk density) of 43.1%. The experimental crystallinity of Attane 4001 was found to be 34.2% when measured by DSC. The experimental measurement involved cooling the melt from 480° K. to 285° K. at a rate of 20°/minute and heating from 285° K. through the melt to 480° K. at a scan rate of 20°/minute using a DSC-2 differential scanning calorimeter available from Perkin-Elmer Corporation, Norwalk, Connecticut, U.S.A., with ice-water bath cooling and nitrogen atmospheric control. This experimentally determined crystallinity corresponds to about 80% of the theoretical value based on density.

Polymer crystallinity, density and enthalpy of melting data may be found in the tables on pages V/15 through V/26 of *The Polymer Handbook*, 3rd Edition, J. Brandrup and E. H. Immergut, editors, Wiley & Sons, New York, New York, 1989. Measurement of polymer crystallinity by DSC is described in *Thermal Characterization of Polymeric Materials*, Edith Turi, editor, Academic Press, New York, New York, 1981, p. 296.

Suitable ductile thermoplastics, therefore, are expected to include thermoplastics having a crystallinity not greater than about 60% when measured by DSC after processing.

To maximize conformability, preferred polyolefins are characterized by very low crystallinity and by low tensile strength. In the case of composites which will be used for permanent (i.e. nonremovable) applications, the list of suitable polyolefin polymers expands since minimum tensile strength is not a primary requirement. However, in the case of composites to be used in forming the base or conformant layer of a removable pavement marking strip, the tensile strength of the bulk polyolefin component of the composite material should be at least 8.0 MPa and preferably at least 20 MPa (by ASTM method D882) when used in a 250 micrometer thick sheet.

The nonreinforcing mineral particulate component of the composite material is also an important consideration in achieving desirable mechanical properties in the composite. Nonreinforcing mineral particulate means a mineral additive, in particulate form, which when employed in an intimate mixture with polyolefin, serves to produce desirable conformance and other mechanical properties in the resulting composite. Nonreinforcing mineral particulates do not significantly increase the tensile strength of the resulting composite relative to the bulk polyolefin.

Generally, the incorporation of nonreinforcing mineral particulates results in composites with performance properties superior to the polyolefin component when considered for road marking tape. The nonreinforcing mineral particulate may be produced from naturally existing ores or may be synthesized from other raw materials. Possible examples of sources of nonreinforcing mineral particulates are calcium carbonate, Kaolin (aluminum silicate), talc, alumina trihydrate, silica, wollastonite, mica, feldspar, barytes, calcium silicate, attapulgite, and various hollow beads of synthetic and natural minerals. Generally, low Mohs' hardness is also preferred in nonreinforcing mineral particulate selection.

The preferred nonreinforcing mineral particulate is calcium carbonate. Calcium carbonate is generally available in five forms: water-ground, dry-ground, ultra-fine ground, precipitated, and surface treated. Of these forms, those prepared by grinding and classifying of high purity limestone and having surfaces treated with fatty acid type reagents, such as stearic acid are preferred.

Particulate size is a significant factor to be considered in selection of an appropriate nonreinforcing mineral particulate. Calcium carbonate is commercially available with a mean particle size (MPS) of less than 1.0 micrometers to greater than twenty micrometers as measured by the PLA Sedigraph Method 38–73. Calcium carbonate from about 1.0 micrometers MPS to about 20 micrometers MPS is preferred for the preparation of the composite material. Calcium carbonate of at least 2 micrometers MPS is more preferred and especially calcium carbonate of 3 micrometers MPS is most preferred.

Particle size distribution is also a consideration in selection of an appropriate particulate. The most preferred 3 micrometer MPS material (before surface treatment) has about 92% of its particles smaller than 10 micrometers; about 72% smaller than 5 micrometers and about 12% less than 1 micrometer. In situations where extensive proportions of fines are present, it may be necessary to select a calcium carbonate source with a larger MPS to achieve desired conformance properties.

Preferred sources of calcium carbonate include Q1; Q1T; Q3; Q3T; and Q200T brand calcium carbonate available from the Calcium Carbonate Division of J. M. Huber Corporation; Quincy, Ill. Q1 and Q1T are about 1.0 micrometer MPS calcium carbonate; Q3 and Q3T are about 3.0 micrometer MPS calcium carbonate; and Q200T is about 200 micrometer MPS calcium carbonate. The Q1T, Q3T, and Q200T have stearic acid treated surfaces; however, the indicated MPS dimensions refer to particle size before coating with fatty acid type reagents.

Preferably, the composite also includes a pigment for enhancing its visual appearance. A preferred pigment is titanium dioxide. A second pigment is a yellow pigment such as lead chromate.

One embodiment of the invention is a composite material, suitable for conformant marking tapes which may be applied to roadways at low or cool temperatures. Generally, to select a polymeric material for a conformant layer suitable for application to roadways at both low and moderate temperatures, the elastic modulus of the material should be relatively temperature independent over the desired temperature range. Crystalline thermoplastic polymeric materials having a glass transition point below the desired temperature range typically exhibit some degree of temperature independence in their elastic modulus below their melting point. The polymeric material should have low (e.g. less than 10,000 lbs./in$^2$ (70 MPa)) stress to deform to 115% of initial sample length. Materials which require less force to deform are easier to place in contact with (i.e., conform to) rough surfaces.

A useful means by which to characterize the temperature dependence of the stiffness of polymeric materials is the measurement of the dynamic mechanical property behavior of the material over the temperature range of interest. Dynamic mechanical analysis can be used to measure dynamic storage modulus, or stiffness, as a function of temperature. A number of analytical instruments capable of making such measurements are available commercially, among them, the Dynamic Mechanical Thermal Analyzer (DMTA), available from Polymer Laboratories, Inc. of Amherst, Massachusetts, U.S.A.

Dynamic storage modulus has been explained in *Viscoelastic Properties of Polymers*, Third edition, by J. D. Ferry, J. Wiley & Sons, NY, 1980. Dynamic storage modulus of the unvulcanized rubber sheet materials of Example 1 of U.S. Pat. No. 4,490,432 changes by a factor of not less than 30, when tested over the temperature range from 0° C. to 50° C. at a frequency of 10 Hz using the Polymer Laboratories DTMA. The conformable composite sheet materials of this invention change in elastic storage modulus by less than a factor of 10, and most preferably by less than a factor of 3 over this temperature range.

The lack of a strong temperature dependence of the properties of the conformable composite sheet materials of this invention over this temperature range is advantageous. On cooler days, the tape will feel and behave substantially similarly to the way it would on warmer days, most particularly, by not becoming too stiff to conform to roadway surface irregularities to form a bond between the marking sheet and the road under cool weather conditions. The conformance layers of the marking sheet of U.S. Pat. No. 4,490,432 become stiff at lower temperatures as the rubber composite approaches its glass transition.

Certain semicrystalline polymers exhibit a lack of strong temperature dependence of mechanical properties above the glass transition temperature of the amorphous content and below the melting temperature of the crystalline domains of the polymer. Some semicrystalline polymers, and especially certain semicrystalline polyolefin polymers, are particularly useful in the preparation of the conformable marking sheet materials of this invention. The ethylene-octene copolymers are most particularly preferred in that they generally meet these selection criteria.

It is also desirable to include a stabilizing agent in the composite in order to improve resistance to U.V. light and/or heat of both the composite and any pigment present in the composite. Preferred stabilizing agents are hindered amine light stabilizers (HALS) and may be present at levels up to about 5%. Exemplary HALS stabilizing agents are Chimassorb 944 available from Ciba-Geigy Corp., Additives Division, Hawthorne, New York and Cryasorb UV3346 available from American Cyanamid Co., Wayne, N.J.

Formulations of the composite may be prepared using a mixture described in volume fractions for each of the components. Preferably, the nonreinforcing mineral particulate (for example, calcium carbonate) and the pigment (for example, titanium dioxide) comprise up to about 30% by volume of the composite material, the pigment comprising about 3% by volume of the composite material. If the pigment is omitted, at least about 58 volume percent of the composite may be ultra low density polyethylene.

The polyolefin, nonreinforcing mineral particulates and optional visibility increasing pigments may be mixed in a compounder 12 as schematically shown in FIG. 1. A preferable compounder 12 is a twin screw mixer. If the compounder is a twin screw mixer, the resulting composite material is first extruded into a water bath 14, then chopped in chopper 16 into granules or pellets. Preferably, the composite pellets are dried in drier 18 to about 0.05% by weight moisture content as measured by ASTM method D280. Alternatively, the twin screw mixer may extrude to a gear pump which in turn discharges to a film or sheet producing apparatus as described below.

An alternative compounding unit is a two-roll rubber mill. If a two-roll rubber mill is employed as the compounder, the resulting composite material is removed from the mill in sheets about 1 cm in thickness, cooled and then chopped in chopper 16 into granules or pellets. Preferably, the composite pellets are dried in drier 18 to about 0.05% by weight moisture content as measured by ASTM method D280.

Formation of Conformant Layer

The granules of composite material are subsequently extruded into a layer or film using an extruder 20, e.g. a single screw extruder, with a film die 22. The composite film may be extruded at thicknesses of from about 3 to about 20 mils (76–508 micrometers); preferably from about 7 to about 14 mils (178–356 micrometers) and most preferably 10 mils (254 micrometers). The resulting film 31 is useful as a marking sheet or as a component in a laminate marking sheet.

As a pavement marking tape, the film 31 may be attached to a roadway surface using an adhesive system applied first to either the roadway or the tape. Pressure-sensitive adhesives are preferred, but heat-activated, solvent-activated or contact adhesives may be used. Preferably, however, the composite tape may first be supplied with a pressure-sensitive adhesive layer such as described in U.S. Pat. No. 3,451,537, example 5.

A top or exposed layer which is suitable for high visibility marking and carrying of reflecting elements and skid-resisting particles may also be formed of thermoplastic material. Preferred top layer thermoplastic materials include ethylene acrylic acid (EAA) copolymers and ethylene methacrylic acid (EMAA) copolymers, and mixtures of EAA and EMAA; as well as ionically cross-linked EMAA. Preferably, the exposed top layer includes a visibility enhancing pigment such as titanium dioxide.

A preferred source of material for forming the top layer includes the EMAA polymers, particularly the Nucrel brand resins available from the E. I. Dupont de Nemours and Company, Wilmington, Del. Other ethylene copolymers that may be employed include ethylene acrylic acid (EAA), ionically cross-linked ethylene methacrylic acid (EMAA) ionomers (such as for example, the Surlyn brand ionomers available from E. I. Dupont de Nemours and Company), ethylene n-butyl acrylate (EnBA), and ethylene vinyl acetate (EVA) and blends thereof.

Such polyolefins also can be used, independent of any conformance layer. Typical thickness would be 80–250 micrometers. Acid containing ethylene copolymers, such as EMAApolymers (above-mentioned Nucrel products), are the preferred olefins for such marking sheets. To allow ease of application to a roadway surface, the lower surface of the olefin sheeting of the marking can be laminated to a pressure sensitive adhesive. To improve retroreflectivity and/or skid resistance, particles may be embedded in the upper surface of the sheeting. The processes for laminating adhesive and embedding particles are described elsewhere in this specification. Alternatively, the polyolefin sheeting may be laminated to previously known conformance layers, such as aluminum foil, and a scrim may be laminated to the polyolefin sheet. Such optional conformance layers may be accompanied by an adhesive layer to allow simple attachment to a road surface.

The preferred acid copolymers for the top, layer have an acid content of at least 3% by weight. The preferred copolymers have melt indices less than about 500 grams/10 minutes. The polyolefin copolymers having a melt index of less than about 150 grams/10 minutes are more preferred, and polymers having melt indices in the range of 100 grams/10 minutes to 10 grams/10 minutes are most preferred.

In general, polymers with lower melt indices are too viscous for the embedding process to be described subsequently in this application. Higher melt indices are preferred for the particle embedding process. A polymer with a higher melt index may be embedded with particles at more moderate embedding temperatures. Additionally, because the less viscous polymers tend to favor capillary wetting of the particles embedding time requirements may be moderated. However, lower melt indexes may be useful in the alternative embodiment embedding process which incorporates a nipping step, as described elsewhere in this specification. Polymers with excessively high melt indices are more difficult to extrude and may soften undesirably for pavement marking in hot climates.

Lamination Method

The present invention also includes a method for preparing a laminated road-marking tape from the composite materials of the present invention. The method includes providing a cooled casting roller 24, associated with die 22, and a rubber nip roller 26 adjacent the casting roller in order to provide a nip 28. A carrier web 30 (e.g. polyethylene terephthalate (PET)) of thickness of approximately 2.4 mils (61 micrometers) is threaded through the nip 28. The earlier described polyolefin/nonreinforcing mineral particulate composite is melt-extruded through the film die 22 onto the carrier web 30 and into the nip 28. The temperature of the melt of the ULDPE/$CaCO_3$ composite at film die 22 is typically in the range of about 425°–475° F. (218°–246° C.). The composite film 31 is approximately 10 mils (254 micrometers) in thickness. Casting roller 24 can be about a 24-inch (61cm) diameter roller turning at a rate so as to provide a cooled casting surface 25 traveling at a rate of about 2 to 6 feet per minute (0.6–1.8 meters per minute). The combined carrier web and composite sheet 39 is fed through a second nip 40 between a rubber nip roller 42 and a second cooled casting roller 44, and a polyolefin top film 41, as earlier described, is extruded through a film die 46, by extruder 47, upon the composite layer of the laminate in the nip 40 to provide a laminate 50. The preferred top film 41 has a thickness of from about 2 mils to about 10 mils (50–250 micrometers), more preferably from about 3 mils to about 6 mils (75–150 micrometers). Most preferably the top film 41 is approximately 4.5 mils (114 micrometers) in thickness.

In an alternative embodiment, the process of forming a conformable marking sheet of this invention comprising a composite conformance layer and a top layer may employ a suitable adhesive or "tie" layer interposed between the conformance layer and the top layer as a means of improving the bond between those two layers. The use of a tie layer is particularly advantageous in cases where the top layer and conformance layer comprise especially dissimilar materials. In such cases, the two layers may be difficult to bond to one another. Choice of an appropriate tie layer having a proper affinity toward both materials (i.e., those of the top layer and the conformance layer), can provide an effective enhancement of the bond between the two layers. In one embodiment of this invention, a thin layer of a pressure sensitive adhesive is provided between the top layer and the conformance layer of the conformable marking sheet. In another embodiment, the surface of one of the two layers, i.e. either the conformance layer or the top layer, is provided with a thin layer (tie layer) of material having an affinity for both layers. Preferably, the thin layer on the surface to be bonded is provided by coextruding with the first layer. Subsequently, the top layer is extruded into contact with the tie layer, thereby forming the laminate. A further embodiment entails the inclusion of a tie layer between a top layer and a conformance layer of the invention by means of a three layer coextrusion.

Embedding Process

The visibility or signaling performance of the marking sheet may be improved by the addition of transparent microspheres and/or skid-resisting particles to the upper surfaces. Methods of applying microspheres and/or skid-resisting particles to an upper surface through the use of a thermoset bead bond layer have been previously disclosed in U.S. Pat. No. 3,451,537, incorporated herein by reference.

Laminated film 50, as previously described, may be suitably embedded with glass reflective beads and/or skid-resisting particles through the use of a heated roller 54 having a surface 56 with a temperature of approximately 400° F. (204° C.). The preferred heated roller 54 is a horizontally mounted cylinder having a surface 56 moving at approximately 2 to 6 feet per minute (0.6–1.8 meters per minute). After a brief initial contact time, the microspheres or particles are applied to the softened, upward directed surface of the thermoplastic film by dispenser 58. This allows sufficient time (e.g. 30 seconds) for the microspheres and/or skid-resisting particles to embed in the softened thermoplastic film surface. After the laminate film with embedded microspheres 60 exits from the heated roller 54, it is cooled, thereby fixing the embedded particles at the desired level of embedment in the surface.

Figure 2:
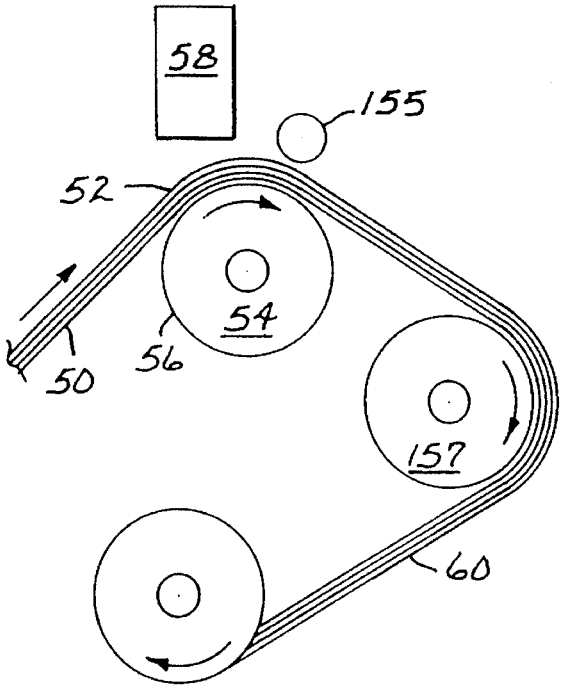
FIG. 2 is an alternative embodiment of the embedding process of the present invention.

In an alternative embodiment, schematically shown in FIG. 2, a nip roller 155 may also be employed to force the embedding of particles into the surface 52 during the period in which the film is maintained in the softened, heated condition. Preferably, a reduced temperature is used at the heated roller 54 when a nip roller 155 is employed. In the alternative process of FIG. 2, the temperature of roller 54 is substantially lower than in the process of FIG. 1 (typically about 115° C.). Employment of the nip roller 155 shortens the time required for embedding, since the nip roller 155 quickly forces the particles into the softened film 50. Employment of a nip roller 155 also improves process control of the depth of embedding. Provision of a thickness adjustment to the nip roller 155 further facilitates control of the depth of embedding. After nipping the particles into the surface, the sheet may also be passed over a second heated roller 157, preferably at a slightly higher temperature than roller 54 to allow for reflow of the polymer to particles and additional wetting of the particles to occur.

The most preferred conditions of temperature and time for embedding are those that are sufficient to obtain desired particle (bead) embedment (e.g. 50%). Appropriate adjustment of time and temperature in this process is within the skill of the art for polymers having the melt indices described above.

Microspheres or glass beads, such as beads of 1.5 and 1.9 refractive index are suitable sources of reflectance. Appropriate sizes of beads range from about 20 to about 50 mesh (300–850 micrometers). The beads are applied at a rate of approximately 50 grams of beads per 4-inch by 6-inch of area (i.e., approximately 50 grams of beads per 154 square centimeters). Skid-resistant particles, such as, for example, 30-mesh (600 micrometers) aluminum oxide particles may be applied at ratios of preferably about 8–12 grams per 4-inch by 6-inch area (i.e., about 8–12 grams per 154 square centimeters). Preferably, the beads and particles may be treated with well-known coupling agents, such as silanes, titanates, and zirconates, to improve their adhesion to the film after embedding. A most preferred coupling agent is UNION CARBIDE™ A-1100 brand gamma-aminopropyltriethoxy silane available from the Union Carbide Corporation of Danbury, Conn.

Non-polar polymers may be improved in their ability to bind and retain embedded glass beads and/or skid-resisting particles by preliminary treatment to chemically modify the thermoplastic surface by corona treatment, flame treatment, E-beam treatment or plasma treatment, all of which serve to render the surface more polar.

Figure 3:
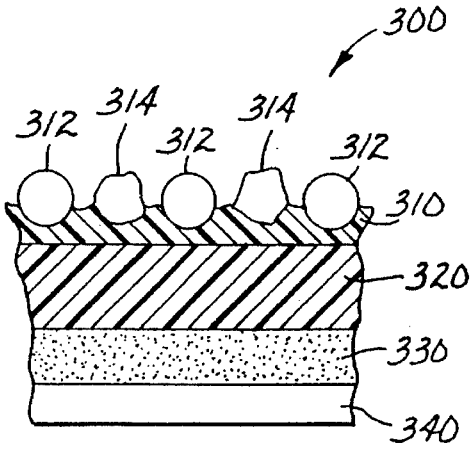
FIG. 3 is a schematic cross-section of a conformant marking tape of the present invention.

A representative marking sheet or tape is shown at 300 in enlarged schematic section in FIG. 3 and includes a top or visible layer 310 with partially embedded glass microspheres 312 and skid-resistant particles 314, a base or conformance layer 320, a pressure sensitive adhesive layer 330 and a release liner 340. Typically the thicknesses of these layers range from about 20 to about 180 micrometers for the top layer 310; from about 200 to about 600 micrometers for the conformance layer 320; and from about 80 to about 200 micrometers for the adhesive layer 330.

Conformability

In general, desirable preformed marking sheets must be able to "conform" to the roughness of the roadway surface. The marking sheet must stretch and bend during application to bring the adhesive layer of the preformed marking sheet into complete contact with the rough texture of the road surface. In contrast, after applying nonconformable marking sheets, only a partial contact between the roadway and the sheet's adhesive layer is observed or alternatively strong residual stresses within the marking sheets will tend to subsequently disrupt the adhesive bond with the roadway surface.

Laboratory test methods which model conformance to rough surfaces provide useful insight to select appropriate materials for incorporation into conformable marking sheets. Those tests include measurements of forces required to deform materials, retractive forces after deformation, inelastic deformation values and effects of temperature on mechanical properties. An elongation to 115% of original length is a good approximation of the deformation experienced by conformable marking sheets that are conformed to a rough roadway surface.

Conformability of a marking sheet or layer can be evaluated in several ways. One simple way is to press a layer or sheet of the material by hand against a complex, rough or textured surface, such as a concrete block or asphalt composite pavement, remove, and observe the degree to which surface roughness and features are replicated in the layer or sheet. Layers or sheets of the conformant composite material of this invention will conform to complex shapes and rough surfaces.

Elastic recovery is the tendency of a layer or sheet to return to its original shape after being deformed. Delayed elastic recovery can be observed by noting the tendency of the replicated roughness to disappear over time. A simple test for delayed elastic recovery is to use a blunt instrument to indent a film or sheet. The ease with which an impression can be made and the permanence of the impression may be used to form rough comparative judgments about the conformance properties of the material used to form the sheet or layer.

Conformable sheet materials of this invention must be capable of being deformed under reasonable forces in order to take on the shape of the road surface irregularities and thereby to allow formation of a good bond to the road surface. By reasonable forces is meant that after application of the marking sheet to a road surface and rolling over the applied, flat marking sheet with a suitable tamping means, the marking sheet conforms to the road surface. In such an application, the tamped marking sheet substantially replicates the surface texture of the road. The suitable tamping means should not be excessively unwieldy. For prior art preformed pavement marking tapes, a tamping cart with a load of about 200 lbs. (90 kg) has been typically employed in the application of marking tapes.

Another assessment of the suitability of the conformable composite materials useful for making marking sheets of this invention can be obtained as follows. First, the force required to deform the material a suitable amount is measured. Second, a portion of the induced strain is relieved. Finally, the retractive force remaining in the material at the reduced strain level is measured. A specific example of measuring both the force to deform and the retractive force is as follows. First, a sample of conformance layer material is deformed or extended to 115% of its original length by stretching the sample at a strain rate of 0 05 $sec^{-1}$ and measuring the stress at the 115% deformation. Next, the strain is released, at the rate of 0.05 $sec^{-1}$ and the deformed sample material is allowed to return to 110% of its original length. Finally, the retractive force is measured at the 110% deformation. This measurement can be made using a standard tensile testing apparatus such as, for example, the servohydraulic tensile testers available from MTS Systems Corporation of Minneapolis, Minnesota.

Conformable composites of this invention exhibit a force to deform a sample to 115% of original sample length of less than 20 lbs. per inch width (35 NT per cm width) and a retractive force at 110% deformation, following the 115% deformation, of less than 8 lbs. per inch width (14 NT per cm width); preferably, a force to deform a sample to 115% of initial sample length of less than 15 lbs. per inch width (26 NT per cm width) and a retractive force at 110% deformation, following the 115% deformation, of less than 5 lbs. per inch width (9 NT per cm width); and most preferably, a force to deform a sample to 115% of initial sample length of less than 10 lbs. per inch width (18 NT per cm width) and a retractive force at 110% deformation, following the 115% deformation, of less than 2 lbs. per inch width (3.5 NT per cm width) when tested as described above at a temperature of 25° C.

When semicrystalline polymers are used in the preparation of the conformable sheet materials of this invention, the force required to deform the material can be advantageously modified by control of the degree of crystallinity of the polymer, i.e. for conformance layer films of a given thickness, materials having a lower level of crystallinity are more easily deformable.

Another test for conformability is available through the following sequence of steps: 1. A test strip (standard strip size for tensile strength testing) is pulled (i.e., deformed or strained) in a tensile strength apparatus (at, for example, a strain rate of 0.05 $sec^{-1}$ which also may be expressed as 300%/minute) until it is strained some predetermined distance, e.g. 115% of original sample length. 2. The pull is reversed and the machine returned to its starting point, causing a complete release of the tensile stress in the sample. 3. On repeated tensile deformation, no force is observed until the sample is again taut. 4. The strain at which a resisting force is first observed on the second pull (i.e. when the sample again becomes taut) is observed. 5. The strain at which resistance is first observed on the second pull, divided by the first strain is defined as inelastic deformation (ID). A perfectly elastic material would have 0% ID, i.e., it would return to its original length. Metals approach 90% ID, but yield only at very undesirably high tensile stresses. Conformable composite materials of this invention combine desirably low force to deform and ID greater than 10%, preferably greater than 20%, more preferably not less than 30% at 25° C.

Preferably, the force required to achieve 15% strain (i.e., deformation) in a base sheet (initial thickness typically about 250 micrometers) is less than 25 lbs. per inch of sample width (44 Newtons/cm of sample width) and more preferably less than 10 lbs. per inch (18 NT per cm). For example, for a complete pavement marking sheet of this invention consisting of a thermoplastic top layer, a conformant composite material base sheet, and an adhesive, with an initial thickness typically about 525 micrometers, the force required to achieve 15% strain (i.e. 115% deformation from original sample length, as explained above) is less than 25 lbs. per inch of sample width (44 Newtons/cm of width). Force per unit of width is a common way to describe stresses in tape samples.

Conformability may also be evaluated by applying strips of a marking sheet being evaluated and including a pressure sensitive adhesive layer across a series of U-groove depressions in a metal panel. Each of the U-grooves of the series has a constant radius but has an increasing depth which, in order for a strip of sheeting to be conformed thereto, requires that the sheeting have an elongation of about 5%, 10%, 15%, and 25%, respectively (i.e. deformation to 105%, 110%, 115%, and 125% of original length). In the evaluation procedure, sheeting is first applied by moderate hand pressure to the flat surface of the metal panel so as to bridge the U-grooves. Subsequently, the sheeting is pressed into each of the U-grooves of the series. Sheeting conforming to a particular U-groove "tacks" or adheres to the sides of the U-groove and remains "tacked" to the sides of the U-groove. Sheeting lacking adequate conformance for a particular groove, either fails to "tack" initially or initially "tacks" but pulls free of the sides of the U-groove a few moments later. Sheeting lacking desirable conformability fails to elongate, tack, and/or remain "tacked" in the U-groove corresponding to 5% elongation. Highly conformant sheeting elongates, "tacks" and remains "tacked" at the U-groove requiring as much as 25% elongation. For purposes of this description such a test is referred to as a "U-Groove Test".

Another characteristic of conformant sheets of this invention is the unloading force present in the sheet at 110% deformation subsequent to a 115% deformation. Specifically, this characteristic may be measured by stretching the sheet to 115% of its initial length and immediately returning to its initial length. The stretching and returning strain rates should be 0.05 $sec^{-1}$ based upon the original sample length. The residual load present at 110% stretch on the return cycle is measured and expressed in terms of force per unit width. For the purposes of measuring the sheets of this invention, the tests of unloading force is measured using an MTS Series 810 tensile testing machine (a standard tensile strength testing instrument) on test samples 2.5cm wide and about 10cm in length between grip faces (also termed gauge length). The test is performed at extension and retraction rates of about 0.508 cm/sec. Temperatures of both 2° C. and 25° C. should be employed.

In addition to polyolefin marking sheets having no conformance layer described previously, the present invention also envisions two types of conformable marking sheeting, specifically, temporary removable conformable marking sheets and permanent (nonremovable) conformable marking sheeting. The removable conformable marking sheeting of this invention is particularly useful in situations where a temporary traffic pathway through a construction work zone must be marked with a durable sheeting having dependable adhesion to the roadway. Often, such work zones require particularly efficient marking since they may lack adequate nighttime illumination and .present unexpected traffic pathways. At some time during construction, alteration of the temporary markings may be required. One of the most efficient methods of alteration of the marking is removal of the marking sheet from the pavement. Marking sheets having tensile strength sufficient to overcome the adhesion to the roadway can be removed as a unit. Marking sheets lacking such tensile strength must be removed by scraping, grinding or similar less efficient methods. In contrast, permanent marking sheeting need not include such tensile strength since the efficiency of removal is not a significant consideration in permanent applications.

Appropriate tear resistance and tensile strength are important features of conformable composite sheet materials of this invention. The preformed sheet is typically applied to surfaces using application equipment common to the art. For the material to be capable of such application, the tensile strength must be sufficiently high to be carried through the application equipment. If there are any nicks or cuts in the edges of the sheet, the tear resistance should be great enough so that the tape continues to be carried through the application equipment without breaking.

For the case of a temporary marking with good removability characteristics, the requirements of high tear resistance and tensile strength are much more demanding. The sheet must be sufficiently strong to allow removal from road surfaces. The tensile strength of the sheet must be greater than the force required to peel it from the road. Removable marking sheets of this invention have tensile strengths not less than 5 lbs. per inch width (9 NT per cm width) and more preferably not less than about 10 lbs. per inch width (18 NT per cm width).

For a removable marking sheet of this invention the tear strength of the sheet must be sufficiently high so that if there are any nicks, cuts or holes in the tape which may have been caused by factors relating to its presence in the roadway environment, it will not tear and the tape will be removable from the road in substantially large pieces. Tear strength of conformable composite layers of this invention can be characterized with a trouser tear test method (ASTM Test No. D1938–85)using a conventional tensile test apparatus. In this test method, a 2"× 6" (5.1cm by 15.2cm) sample of conformable sheet material is provided with a 2" (5.1cm) notch parallel to and 1" (2.5cm) from either edge of the longer dimension. The test sample is placed in the grips of the tensile tester in a trouser tear geometry and the jaws moved apart at a rate of about 12"/sec (30.5cm/sec). The force required to tear the conformable composite layers of this inventions is not less than 2 lbs. (9 NT), more preferably not less than 5 lbs. (22 NT) and most preferably not less than 10 lbs. (44 NT) when tested in this manner.

The force to deform, tear resistance, tensile strength retractive force and inelastic deformation can be modified through the use of additional fillers and choice of materials. In particular, the inelastic deformation exhibited by a material can be increased by the addition of nonreinforcing fillers to the composition of the conformance layer composite sheets especially when the polymers of the composition are polyolefins. The advantageous selection of certain semicrystalline polymers with glass transition temperatures below and melt temperatures above the use temperature application range of conformable marking sheets can lead to conformable marking sheets with compositions which exhibit consistent properties over the desired application temperature range. The force required to deform a conformable marking sheet can be favorably modified by control of the extent of crystallinity when semicrystalline polymers are used in the conformance layer of marking sheets of this invention. For a given thickness, polymeric materials of lower crystallinity are more easily deformed than those of greater crystallinity.

Although increasing the thickness of the conformance layer will increase the tensile strength and tear resistance of the sheet, it will also increase the force required to deform the sheet. For a given composition, there exists an optimal thickness balancing conformance with tensile strength and tear resistance. As earlier mentioned, composite material layers from about 3 to about 20 mils (76–508 micrometers) may be used, but layers from about 7 to about 14 mils (178–356 micrometers) are preferred. Layers of about 10 mils (254 micrometers) are especially preferred.

In the following examples, all percentages are by weight.

EXAMPLES:

Example 1

Pellets of Dowlex 4001 ultra low density polyethylene available from Dow Chemical and Hubercarb Q3T calcium carbonate powder available from J. M. Huber Corporation were fed into the throat of a Baker-Perkin twin screw compounder by means of dry powder screw conveyers with feed rates such that the resultant mixture of materials was in a ratio of 70 to 30 by volume. The twin screw compounder was provided with heating capability to allow melting of the polymer and mixing and dispersion of the solid into the polymer. The mixture was extruded through a strand die into a water bath for cooling. The cooled strands were chopped using a Jetro pelletizer. The pellets were dried and extruded through a film die using a Killion single screw extruder to form a 250 micrometer thick sheet of composite conformance sheet material.

Example 2

Pellets from Example 1 and pellets of a 50% titanium dioxide concentrate dispersed in linear low density polyethylene (PM80230 available from Quantum Chemical Corporation of Cincinnati, Ohio, U.S.A.) were combined in a ratio of 83 parts by weight of the pellets from Example 1 to 17 parts by weight of the titanium dioxide concentrate pellets and then tumbled in a pail tumbler to provide a uniformly distributed mixture. The pellet mixture was dried and then extruded using a Killion single screw extruder equipped with a film die to form a 250 micrometer thick sheet of pigmented composite conformance sheet material.

Example 3

Pellets of Nucrel 699 ethylene-methacrylic acid copolymer available from Dupont and of a pigment concentrate (50% by weight titanium dioxide pigment in ethylene acrylic acid copolymer, Spectratech IM 88947, USI Division, Quantum Chemical Company, Clinton, Mass.), were tumbled in a pail tumbler to provide a uniformly distributed pellet mixture with a titanium dioxide content of 20%, an EAA content of 20% and an EMAA content of 60%. This mixture was extruded through a film die onto a polyester carrier web using a Killion single screw extruder to provide a pigmented top layer for a conformable marking sheet. This top layer on its carrier web was carried over the surface of a hot can heated to a temperature of 210° C., (e.g. sufficiently hot to bring the pigmented top layer material to a softened, nearly molten condition, but not so hot that the polyester carrier web would melt). While in contact with the hot can at the elevated temperature, glass microbeads (200 to 600 micrometers in size, 1.9 refractive index, surface treated with UNION CARBIDE™ A-1100 brand gamma-aminopropyl-triethoxy silane) and small particles of aluminum oxide grit (30 Grit) were sprinkled onto the hot surface of the top layer. The pigmented top layer with the particles on its surface was maintained at the high temperature by wrapping it around the hot can with the web moving at a speed of 4 fpm (0.02 meters/sec) so that the particles could partially sink into the surface of the polymer and that the polymer could wet the surface of the particles while still in the nearly molten state. The web was then passed over a cooler roll to re-solidify the film containing the reflective elements and anti-skid particles in the top surface and wound up into a roll of conformable marking sheet.

Example 4

The extruded conformable composite sheet material of Example 2 was cast onto a polyester carrier web. The mixture of polymer pellets and pigmented polymer pellets used in example 3 were extruded through a film die onto a polyester carrier web using a Killion single screw extruder. The two films were brought together through a heated, pressurized nip with the filled polyethylene film in contact with the pigmented top layer and the two polyester carrier webs on the outside of the laminated composite. The polyester carrier web was stripped from the surface of the ethylene methacrylic acid copolymer side of the composite to leave a laminate of polyester carrier web, calcium carbonate filled polyethylene composite conformance layer and pigmented ethylene methacrylic acid containing top layer. This multi-layer laminate on its carrier web was carried over the surface of a hot can heated to a temperature of 210° C., (e.g. sufficiently hot to bring the pigmented top layer material to a softened, nearly molten, condition, but not so hot that the polyester carrier web would melt). While in contact with the hot can at the elevated temperature, glass microbeads (200 to 600 micrometers in size, 1.9 refractive index, surface treated with aminopropyl trimethoxy silane) and small particles of aluminum oxide grit were sprinkled onto the hot surface of the top layer. The pigmented top layer, with the particles on its surface, was maintained at the high temperature by contact with the hot can with the web moving at a speed of 4 fpm (0.02 meters/sec). The particles partially sank or embedded into the surface of the polymer and the polymer appeared to creep up the sides of the particles somewhat during this time. The web was then passed over a cooler roll to re-solidify the film containing reflective elements and anti-skid particles and was subsequently wound to form a roll of conformable marking sheet.

Example 5

Pellets of Nucrel 699 ethylene-methacrylic acid copolymer available from Dupont and a 50% by weight titanium dioxide pigment concentrate in ethylene acrylic acid copolymer, Spectratech IM 88947 available from USI Division of Quantum Chemical Company of Clinton, Mass., were tumbled in a pail tumbler to provide a uniformly distributed mixture of the pellets with the composition of the mixture such that titanium dioxide content was 20%, an EAA content of 20%, and an EMAA content of 60%. This mixture was extruded through a film die onto a 75 micrometer thick web of deadsoft aluminum foil using a Killion single screw extruder. The foil web with the coating of pigmented polymer was carried over the surface of a hot can heated to a temperature of 210° C., sufficiently hot to bring the pigmented top layer material to a softened, nearly molten, condition. While in contact with the hot can at the elevated temperature, glass microbeads (200 to 600 micrometers in size, 1.9 refractive index, surface treated with aminopropyl trimethoxy silane) and small particles of aluminum oxide grit were sprinkled onto the hot surface of the top layer. The pigmented top layer with the particles on its surface was maintained at the high temperature by wrap on the hot can with the web moving at a speed of 4 fpm (0.02 meters/sec) so that the particles partially sank into the surface of the polymer and that the polymer crept up the sides of the particles while still in the nearly molten state. The aluminum foil Nucrel composite web was then passed over a cooler roll to re-solidify the film containing the reflective elements and anti-skid particles and wound up into a roll of conformable marking sheet.

Example 6

The polyester carrier web of the composite laminate of Example 3 was stripped from the bottom of the polymer film containing reflective and anti-skid elements. A layer of rubber resin pressure sensitive adhesive with a thickness of about 125 micrometers was laminated to the bottom side of the film which had been in contact with the polyester carrier web to provide a self-adhesive reflective conformable marking sheet.

Example 7

The polyester carrier web of the composite laminate of Example 4 was stripped from the bottom of the polymer film containing reflective and anti-skid elements. A layer of rubber resin pressure sensitive adhesive with a thickness of about 125 micrometers was laminated to the bottom side of the film which had been in contact with the polyester carrier web to provide a self-adhesive reflective conformable marking sheet.

Example 8

A layer of rubber resin pressure sensitive adhesive with a thickness of about 125 micrometers was laminated to the aluminum foil side of the composite of Example 5 to provide a self-adhesive reflective conformable marking sheet.

Comparative Results at Room and Cool Temperatures

The U-Groove Test for conformability described above was used to characterize materials of this invention and several commercially available pavement marking sheets. The following materials were tested: Example 2 (with a pressure sensitive adhesive layer laminated to the bottom), Example 6, Example 6 without particles embedded in the top surface, and Example 7 of this invention. Additionally, STAMARK™ 5730 Series, SCOTCHLANE™ A741 Series and SCOTCHLANE™ 5710 Series pavement marking sheets available from the Minnesota Mining and Manufacturing Company, St. Paul, Minn. were tested.

The examples of this invention were provided with a layer of rubber resin pressure sensitive adhesive (of the same type used on STAYMARK 5730 pavement markings) laminated to the bottom surface of the marking sheet. Each of the commercially available marking sheet samples already had a pressure sensitive adhesive on the bottom surface of the marking sheet.

The test panels were formed from aluminum sheet with a thickness of about 0.075mm. The radius of curvature of the grooves was about 12.7 mm.

Strips of test material about 25.4 mm in width were laid across the test panel, bridging the grooves in the test panel. The sheet bridging the grooves was pressed into the groove to make contact with the metal surface of the groove, thereby elongating a portion of the sheet by about 5%, 10%, 15% or 25% (i.e. 105%, 110%, 115% or 125% deformation from original sample length.) Thumb pressure was used to deform the samples. Some of the test samples were not sufficiently conformable to be deformed to the extent necessary to make contact in the groove. Others conformed completely. The test samples were allowed to recover for about 72 hours. Testing was done at ambient room temperature, 23° C., and at cold temperature, 2° C. For the cold temperature testing, the samples were applied to the test panel at room temperature and allowed to equilibrate to 2° C. for about 4 hours. The samples were then pressed into the grooves to test conformability. Gloves were worn to prevent warming of the marking sheets and test panels by hand contact. After deforming the materials at low temperature, the test panels were brought to room temperature and allowed to recover for about 72 hours at room temperature. Results are presented in Table I.

TABLE 1

| MATERIAL | U-GROOVE TEST RESULTS AT 23° C. | U-GROOVE TEST RESULTS AT 2° C. |
|---|---|---|
| Example 2 (with adhesive) | initial: conformed to all grooves; 72 hrs: remained tacked to 10% groove | initial: conformed to all grooves; 72 hrs: remained tacked to 10% groove |
| Example 6 (without particles) | initial: conformed to all grooves; 72 hrs: remained tacked to 15% groove | initial: conformed to all grooves; 72 hrs: remained tacked to 10% groove and partially tacked to 15% groove |
| Example 6 | initial: conformed to all grooves; 72 hrs: remained tacked to 15% groove | initial: conformed to all grooves; 72 hrs: remained tacked to 10% groove and small crack at 25% groove |
| Example 7 | initial: conformed to all grooves; 72 hrs: remained tacked to 10% groove | initial: conformed to all grooves; 72 hrs: remained tacked to 10% groove |
| STAMARK ™ 5730 | initial: conformed to all grooves; 72 hrs: remained tacked to 15% groove | initial: cracked at 10% groove and broke at 15% groove; 72 hrs: failed to remained tacked at 5% groove |
| SCOTCHLANE ™ A741 | initial: conformed to 10% groove; 72 hrs: remained tacked to 10% groove | initial: conformed to 5% groove; 72 hrs: failed to remain tacked to 5% groove |
| SCOTCHLANE ™ 5710 | initial: conformed to 10% groove; 72 hrs: remained tacked to 10% groove | initial: cracked at 10% groove and broke at 15% groove; 72 hrs: failed to remain tacked to 5% groove |

The results show that conformable marking sheets of this invention exhibit improved conformability at room temperature and at lower temperatures relative to the existing pavement marking sheets which were tested.

Although the present invention has been described with reference to the preferred embodiments, workers skilled in the art will recognize that changes may be made in form and detail without departing from the spirit and scope of the invention.

What is claimed is:

1. A conformable pavement marking sheet having a top surface useful as a marking indicium and a bottom surface, said marking sheet comprising:

a conformance layer having a thickness of 75 to 1250 micrometers of a composite material comprising:

50 to 85 volume percent of a ductile thermoplastic polymer selected from the group consisting of polyethylene, polypropylene, polybtuylene, ethylene copolymers, polyvinylidene fluoride, polytetrafluoroethylene, polyvinyl polymers, polyamides, and polyurethanes; and 15 to 50 volume percent mineral particulate having a mean particle size of at least 1 micrometer;

wherein the conformance layer requires, when tested at 25° C. using standard tensile strength apparatus, not more than 35 Newtons force per centimeter of width to deform a sample to 115% of original sample length when tested at a strain rate of 0.05 $sec^{-1}$; and which further comprises a top layer distinct from the conformance layer, 80–250 micrometers thick, comprising a thermoplastic polyolefin.

2. A conformable pavement marking sheet having a top surface useful as a marking indicium and a bottom surface, said marking sheet comprising:

a conformance layer having a thickness of 75 to 1250 micrometers of a composite material comprising:

50 to 85 volume percent of a ductile thermoplastic polymer selected from the group consisting of polyethylene, polypropylene, polybutylene, ethylene copolymers, polyvinylidene fluoride, polytetrafluoroethylene, polyvinyl polymers, polyamides, and polyurethanes; and 15 to 50 volume percent mineral particulate having a mean particle size of at least 1 micrometer;

wherein the conformance layer exhibits, when tested at 25° C. using standard tensile strength apparatus, not more than 35 Newtons force per centimeter of width to deform a sample to 115% of original sample length when tested at a strain rate of 0.05 $sec^{-1}$; and a top layer distinct from the conformance layer comprising a thermoplastic polymer chosen from the group consisting of:

ethylene acrylic acid (EAA) copolymers, ethylene methacrylic acid (EMAA) copolymers, polyethylene (PE), polypropylene (PP), ethylene-propylene-diene terpolymers (EPDM), polybutylene, ionically cross-linked ethylene methacrylic acid copolymer, ethylene n-butyl acrylate (EnBA) polymers, ethylene vinyl acetate (EVA) polymers, ethylene ethyl acrylate (EEA) copolymer, ethylene methyl acrylate (EMA) copolymer, and blends thereof.

3. The conformable pavement marking sheet of claim 2 wherein the top layer further includes semi-embedded particles chosen from the group consisting of retroreflective elements and skid-resistant particles.

4. A conformable marking sheet having a top surface useful as a marking indicium, said marking sheet comprising:

a conformance layer having a thickness of 75 to 1250 micrometers of a composite material comprising:

50 to 85 volume percent of a ductile thermoplastic polymer selected from the group consisting of polyethylene, polypropylene, polybutylene, ethylene copolymers, polyvinylidene fluoride, polytetrafluoroethylene, polyvinyl polymers, polyamides, and polyurethanes; and 15 to 50 volume percent mineral particulate having a mean particle size of at least 1 micrometer;

wherein the conformance layer exhibits, when tested at 25° C. using standard tensile strength apparatus, not more than 35 Newtons force per centimeter of width to deform a sample to 115 % of original sample length when tested at a strain rate of 0.05 $sec^{-1}$; and atop layer comprising a thermoplastic acid-containing ethylene copolymer.

5. The conformable marking sheet of claim 4 wherein the acid containing ethylene copolymer has an acid content of at least 3% by weight.

6. The conformable marking sheet of claim 4 wherein the acid containing ethylene copolymer has a melt index of at least 10 g/10 minutes.

7. A conformable marking sheet having a top surface useful as a marking indicium and a bottom surface, said sheet comprising:

a conformance layer 75–1250 micrometers thick comprising:

60–80 volume percent of ultra low density polyethylene; and

20–40 volume percent of calcium carbonate particles having a mean particle size of at least 2 micrometers;

which conformance layer exhibits, when tested at 2° C., using a standard tensile strength apparatus, not more than 18 NT force per cm width to deform a sample to 115% of original sample length when tested at a strain rate of 0.05 $sec^{-1}$ and not more than 5 NT unloading force per cm width at 110% deformation following a 115% deformation; and further comprising:

a top layer 20–180 micrometers thick and comprising:

75–95 weight percent of a copolymer of ethylene and a comonomer selected from the group consisting of acrylic acid and methacrylic acid; and 5–25 weight percent $TiO_2$.

8. The marking sheet of claim 7 wherein the ratio of the dynamic storage modulus at 0° C. to that at 50° C. is not more than 10:1.

* * * * *

UNITED STATES PATENT AND TRADEMARK OFFICE

CERTIFICATE OF CORRECTION

PATENT NO.: 5,536,569

DATED: July 16, 1996

INVENTOR(S): James E. Lasch, Terry R. Bailey, Gregory F. Jacobs and Roger R. Kult It is certified that error appears in the above-identified patent and that said Letters Patent is hereby corrected as shown below:

Col. 3, line 1, after "polybutylene" insert --,--;
line 2, after "polyvinyl, insert –polymers,--.
line 43, after "onto" delete --.--.
Col. 5, line 38, after "g/cm$^3$" insert --,--.
Col. 6, line 7, delete "e-olefin" and insert --α-olefin--.
Col. 9, line 56, after "top" delete --,--.
Col. 22., line 1, delete "atop" and insert –a top--.
Col. 22, lines 4 and 7, please delete "acid containing" and insert –acid-containing--.

Signed and Sealed this

Thirteenth Day of May, 1997

*Attest:*

*Attesting Officer*

BRUCE LEHMAN

*Commissioner of Patents and Trademarks*